US009599318B2

(12) United States Patent
Oza et al.

(10) Patent No.: US 9,599,318 B2
(45) Date of Patent: Mar. 21, 2017

(54) SOLID STATE LIGHT SOURCE-BASED MODULE CONVERTIBLE BETWEEN LINEAR AND NON-LINEAR SHAPES

(75) Inventors: Napoli Oza, Boise, ID (US); Anil Jeswani, Beverly, MA (US); Yiming Zhang, San Jose, CA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 1019 days.

(21) Appl. No.: 13/370,875

(22) Filed: Feb. 10, 2012

(65) Prior Publication Data

US 2012/0206914 A1 Aug. 16, 2012

Related U.S. Application Data

(60) Provisional application No. 61/441,488, filed on Feb. 10, 2011.

(51) Int. Cl.
*F21V 15/01* (2006.01)
*F21V 7/00* (2006.01)
(Continued)

(52) U.S. Cl.
CPC ..... *F21V 15/012* (2013.01); *F21S 4/24* (2016.01); *F21S 6/002* (2013.01); *F21V 7/00* (2013.01);
(Continued)

(58) Field of Classification Search
CPC .... F21S 4/24; F21S 6/002; F21V 7/00; F21V 15/012; F21Y 2101/00; F21Y 2103/10; F21Y 2115/10
USPC ..... 362/103, 104, 108, 555, 570, 571, 565, 362/581, 154, 155, 166, 171, 178, 184, 362/189, 223, 640, 645, 646, 230, 231, 362/374, 235, 106, 249.01, 153.1, 225, 362/249.08
See application file for complete search history.

(56) References Cited

U.S. PATENT DOCUMENTS 6,055,942 A * 5/2000 Romanak et al. ..... 119/859
6,892,678 B2 * 5/2005 Cheng ..... 119/859

FOREIGN PATENT DOCUMENTS

KR 20-0373227 Y1 1/2005
KR 10-2007-0074092 A 7/2007
(Continued)

OTHER PUBLICATIONS

Sang Cheol Kim, International Search Report and Written Opinion of the International Searching Authority for PCT/US12/24673, Sep. 27, 2012, pp. 1-6, Korean Intellectual Property Office, Daejeon Metropolitan City, Republic of Korea.

*Primary Examiner* — Stephen F Husar
(74) *Attorney, Agent, or Firm* — Shaun P. Montana

(57) ABSTRACT

A lighting module is provided. The lighting module includes a flexible substrate having a first side and a second side, a plurality of solid state light sources, and a flexible housing. The first side of the flexible substrate has conductive traces. The plurality of solid state light sources is placed on the first side of the flexible substrate. The plurality of solid state light sources is electrically connected to the conductive traces. The flexible housing has at least a first shape, which may be linear, and a second shape, which may be non-linear. The flexible housing includes a flexible superelastic material in an austenite phase. The flexible housing is placed in proximity to the flexible substrate to form the lighting module.

19 Claims, 5 Drawing Sheets

(51) Int. Cl.
*F21S 6/00* (2006.01)
*F21Y 101/00* (2016.01)

(52) U.S. Cl.
CPC ..... *F21Y 2101/00* (2013.01); *F21Y 2103/10* (2016.08); *F21Y 2115/10* (2016.08)

(56) References Cited

FOREIGN PATENT DOCUMENTS

KR 10-2009-0010875 A 1/2009
KR 10-2009-0057115 A 6/2009

* cited by examiner

SOLID STATE LIGHT SOURCE-BASED MODULE CONVERTIBLE BETWEEN LINEAR AND NON-LINEAR SHAPES

CROSS-REFERENCE TO RELATED APPLICATION(S)

The present application claims priority of U.S. Provisional Patent Application No. 61/441,488, having the same title and filed Feb. 10, 2011, the entire contents of which are hereby incorporated by reference.

TECHNICAL FIELD

The present invention relates to lighting, and more specifically, to lighting modules including solid state light sources.

BACKGROUND

Conventional lighting modules including solid state light sources typically are shaped similarly to lighting modules including conventional light sources (e.g., incandescent, halogen, fluorescent, etc.). Thus, for example, a spotlight-type module that includes solid state light sources will be rounded in shape, typically with a base so the module is able to be attached to a surface. Similarly, a desk lamp or reading lamp that includes solid state light modules will be linear in shape, as is the convention for incandescent-based desk lamps and reading lamps.

SUMMARY

It is an object of the invention to obviate the disadvantages of the prior art.

It is a further object of the invention to provide a lighting module including solid state light sources that is able to be easily changed from a linear shape to a non-linear shape, and vice versa.

In an embodiment, there is provided a lighting module. The lighting module includes a flexible substrate having a first side and a second side, wherein the first side includes conductive traces; a plurality of solid state light sources placed on the first side of the flexible substrate, the plurality of solid state light sources being electrically connected to the conductive traces; and a flexible housing having at least a first shape and a second shape, the flexible housing comprising a flexible superelastic material in an austenite phase, wherein the flexible housing is placed in proximity to the flexible substrate to form the lighting module.

In a related embodiment, the flexible superelastic material may have a mechanical strength capable of supporting at least the first shape and the second shape of the flexible housing. In another related embodiment, the flexible superelastic material may be a flexible superelastic material capable of deforming reversibly from the first shape to the second shape in the presence of a mechanical load. In a further related embodiment, the flexible superelastic material may be a flexible superelastic material capable of returning to the first shape of the flexible housing after the removal of the mechanical load.

In yet another related embodiment, the flexible housing may have at least two ends and may include an attachment mechanism on at least one of the at least two ends, the attachment mechanism capable of allowing the at least two ends to be attached. In a further related embodiment, the attachment mechanism may be a clip. In another further related embodiment, the attachment mechanism may be a protrusion that attaches to a receptacle, wherein the protrusion may be located on a first of the at least two ends and the receptacle may be located on the second of the at least two ends.

In still another related embodiment, the first shape may be a substantially linear shape. In yet still another related embodiment, the second shape may be a substantially circular shape.

In still yet another related embodiment, the flexible housing may be directly attached to the flexible substrate to form the lighting module. In yet still another related embodiment, the first side of the flexible substrate may be reflective. In a further related embodiment, the second side of the flexible substrate may be reflective.

In yet another related embodiment, the lighting module may further include a base mounted to the flexible housing to support the lighting module.

In still another further related embodiment, the mechanical load may be a cover for the lighting module in the second shape. In yet still another further related embodiment, the cover may be an optical system to focus light emitting from the lighting module in the second shape. In still yet another further related embodiment, the cover may be a reflective end cap for the lighting module in the second shape.

In still yet another related embodiment, the flexible superelastic material may be an alloy. In a further related embodiment, the alloy may be a nickel-titanium alloy.

In another embodiment, there is provided a lighting module. The lighting module includes: a flexible circuit board having a first side and a second side, wherein the first side includes conductive traces; a plurality of solid state light sources placed on the first side of the flexible circuit board, the first side of the flexible circuit board being reflective, the plurality of solid state light sources being electrically connected to the conductive traces; a flexible housing having at least a first shape and a second shape, the flexible housing having a mechanical strength capable of supporting at least the first shape of the flexible housing, the flexible housing capable of deforming reversibly in the presence of a mechanical load to achieve the second shape and capable of regaining the first shape of the flexible housing after the removal of the mechanical load, wherein the flexible housing is attached to the flexible circuit board to form the lighting module; an attachment mechanism located on at least one end of the flexible housing, the attachment mechanism capable of allowing the at least one end to be attached to at least another end of the flexible housing; and a base mounted to the flexible housing to support the lighting module.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Embodiments of the present invention provide a lighting module including solid state light sources that is able to be easily changed from a linear shape to a non-linear shape, and vice versa. The term "solid state light sources", as used herein, refers to one or more light emitting diodes (LED), organic light emitting diodes (OLED), polymer light emitting diodes (PLED) and/or combinations thereof.

Figure 1:
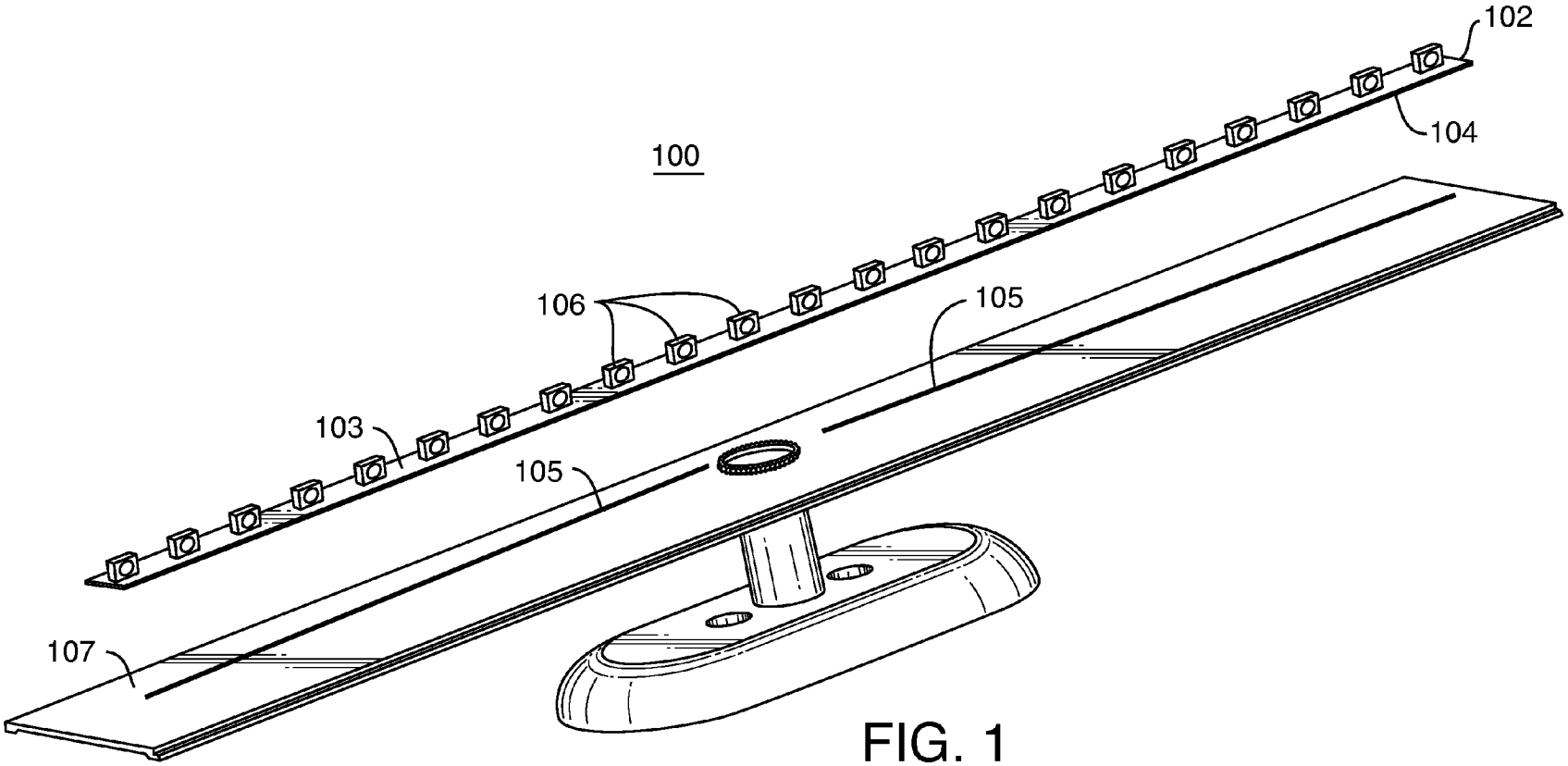
FIG. 1 is a perspective view of a lighting module in its first shape according to embodiments disclosed herein.

FIG. 1 shows a lighting module 100 that has a first shape. The first shape, as shown in FIG. 1, is a linear shape. In some embodiments, the first shape of the lighting module 100 may be, but is not limited to being, a substantially linear shape. Of course, other shapes may be used without departing from the scope of the invention. The lighting module 100 includes a flexible substrate 102 having a first side 103 and a second side 104. The flexible substrate 102 may be, and in some embodiments is, for example but not limited to, a flexible circuit board and/or flexible printed circuit board (PCB). The flexible substrate 102 is capable of supporting electronic components, such as but not limited to resistors, microchips, integrated circuits, and the like. The first side 103 of the flexible substrate 102 includes conductive traces 105. The conductive traces 105 allow electrical signals to traverse electrical components located on the first side 103 of the flexible substrate 102.

A plurality of solid state light sources 106 is placed on the first side 103 of the flexible substrate 102. The plurality of solid state light sources 106 are electrically connected to the conductive traces 105 on the first side of the flexible substrate 102. The plurality of solid state light sources 106 are configured so as to direct light emitted therefrom in a particular direction/directions/pattern. For example, in some embodiments, at least some of the plurality of solid state light sources 106 are side emitting LEDs that are oriented in a particular direction (e.g., when the lighting module 100 is in its second shape 100*b*, inwards) to achieve a desired output as well as other desirous advantages (e.g., source hiding). The plurality of solid state light sources 106 may emit light of any color, and in some embodiments, may emit light that is color mixed to produce white light and/or substantially white light.

In some embodiments, the flexible substrate 102, or some portion thereof, may itself be reflective and/or may otherwise be coated with a reflective material to help increase the light output of the lighting module 100. Thus, in some embodiments, the first side 103 of the flexible substrate 102 is reflective, whether through an inherent property of the flexible substrate 102 or the addition of a reflective material and/or coating. Additionally, or alternatively, the second side 104 of the flexible substrate 102 is reflective, whether through an inherent property of the flexible substrate 102 or the addition of a reflective material and/or coating.

The lighting module 100 also includes a flexible housing 107. The flexible housing 107, in combination with the flexible substrate 102, allows the lighting module 100 to change shapes, such as but not limited to from a first shape (seen in FIGS. 1 and 2) to a second shape (seen in FIGS. 3, 4, and 5). Thus, the flexible housing 107 itself has at least a first shape and a second shape. The first shape, as used herein, is linear and/or substantially linear. The second shape, as used herein, is circular and/or substantially circular. Of course, other shapes (e.g., a polygon-based shape) are possible without departing from the scope of the invention. The flexible housing 107 is placed in proximity to the flexible substrate 102 to form the lighting module 100, as shown in FIG. 1. In some embodiments, as shown for example in FIG. 2, the flexible housing 107 is directly attached to the flexible substrate 102 to form the lighting module 100.

To achieve its flexibility, the flexible housing 107 is made of a flexible superelastic material, i.e., a material having superelasticity. Such materials include, but are not limited to, nitinol alloys (i.e., a nickel-titanium alloy), and thus in some embodiments, the flexible housing 107 is made of an alloy, and more specifically, a nickel-titanium alloy. Superelasticity, sometimes called pseudoelasticity, is a reversible elastic response to an applied stress, caused by a phase transformation between the austenitic and martensitic phases of a crystal. Supereleasticity is from the reversible motion of domain boundaries during the phase transformation, rather than just bond stretching or the introduction of defects in the crystal lattice. A pseudoelastic material may return to its previous shape which is in austenite phase (hence, shape memory) after the removal of even relatively high applied strains. Thus, in some embodiments, the flexible housing 107 is in an austenite phase, and in some embodiments, the flexible housing 107 has a mechanical load placed on it. When mechanically loaded, a superelastic alloy deforms reversibly to very high strains, for example up to 10%, by the creation of a stress-induced phase. When the load is removed, the new phase (martensitic phase) becomes unstable and the material regains its original shape. Thus, flexible superelastic material of the flexible housing 107 is capable of deforming reversibly from the first shape (i.e., a linear shape) to the second shape (i.e., a circular shape) in the presence of a mechanical load 101. In some embodiments, the flexible superelastic material, and thus the flexible housing 107, return to the first shape of the flexible housing 107 after the removal of the mechanical load 101. Further, the flexible superelastic material has a mechanical strength that is capable of supporting at least the first shape and the second shape of the flexible housing 107.

Figure 3:
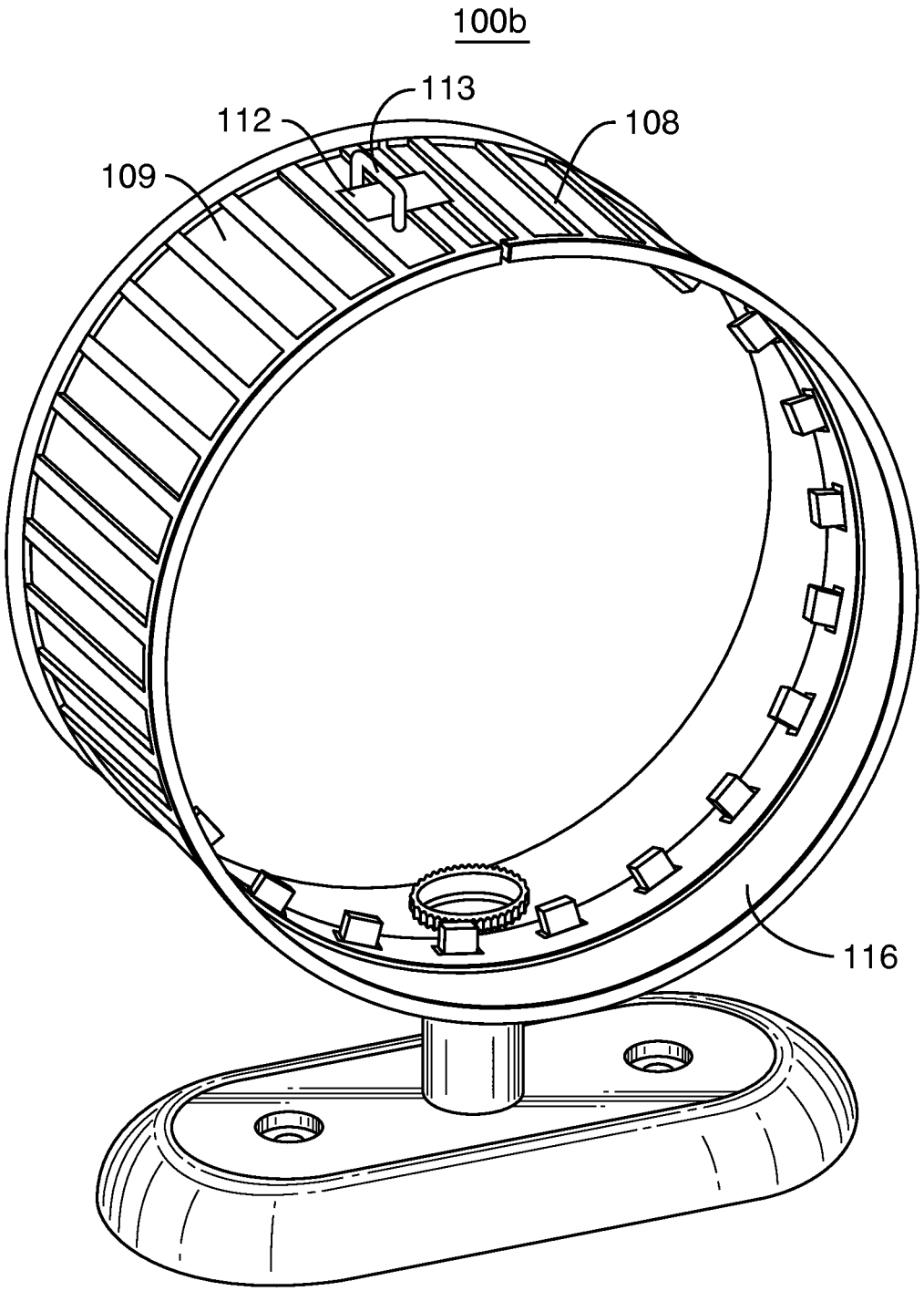
FIG. 3 is a front view of a lighting module in its second shape according to embodiments disclosed herein.
Figure 4:
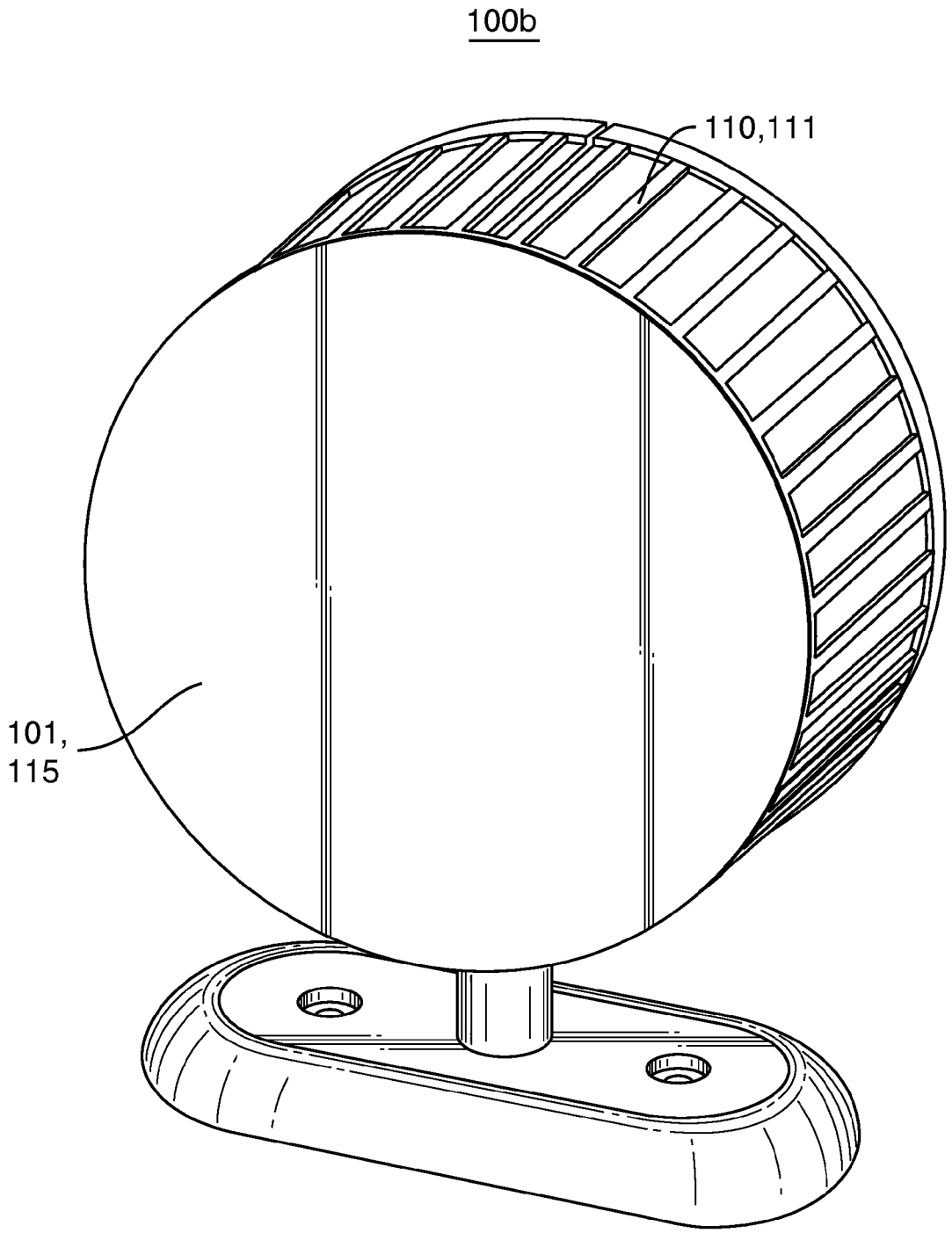
FIG. 4 is a rear view of a lighting module in its second shape according to embodiments disclosed herein.
Figure 5:
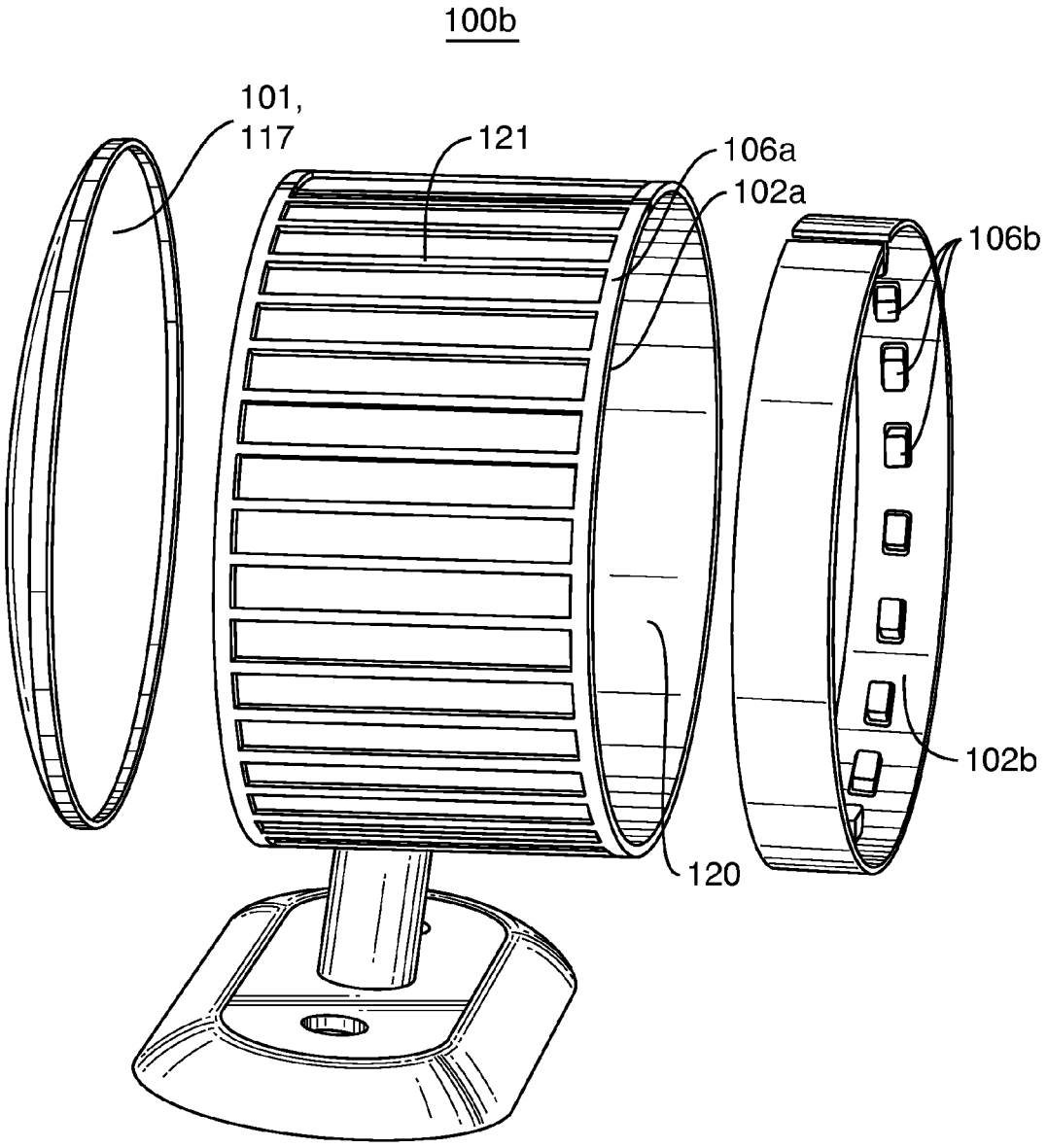
FIG. 5 is an exploded view of a lighting module in its second shape according to embodiments disclosed herein.

The mechanical load 101 may be any load that is placed on the flexible housing 107 to cause it to change from the first shape to the second shape. For example, in some embodiments, the mechanical load 101 is a cover 115 for the lighting module in the second shape 100*b*, as shown in FIG. 4. The cover 115 may be, and in some embodiments is, an optical system 116 to focus light emitting from the lighting module in the second shape 100*b*, as shown in FIG. 3. Alternatively, or additionally, the cover 115 may be, and in some embodiments is, a reflective end cap 117 for the lighting module in the second shape 100*b*, as shown in FIG. 5. Of course, in some embodiments, multiple mechanical loads may, and are, used, such that a lighting module in the second shape 100*b* includes both a reflective end cap 117 (as shown in FIG. 5) and an optical system 116 (as shown in FIG. 3). The cover 115 is capable of retaining the lighting module in the second shape 100*b*, such that when the cover 115 is attached to the lighting module 100 it stays in the shape of the second shape 100*b* (i.e., circular/substantially circular) or whatever other shape may be desired. When the cover 115 is removed, the flexible housing 107 (and thus the lighting module 100) returns to the first shape 100*a*.

In some embodiments, the shape and/or texture of the cover 115 may be designed so as to generate a particular beam pattern and/or light distribution from the light generated by the plurality of solid state light sources 106. In some embodiments, the combination of the cover 106 and an interior surface 120 of the flexible housing 107 may perform such functionality together. Thus, the cover 115 may be coated with a reflective material, such as but not limited to white paint, or may itself be made and/or partially made from a reflective material, and/or otherwise include, at least in part, a reflective material. In some embodiments, the cover 115 may be shaped so as to be attached or otherwise connected to the lighting module 100, 100*a*, 100*b* when in its linear as well as its non-linear shape.

Figure 2:
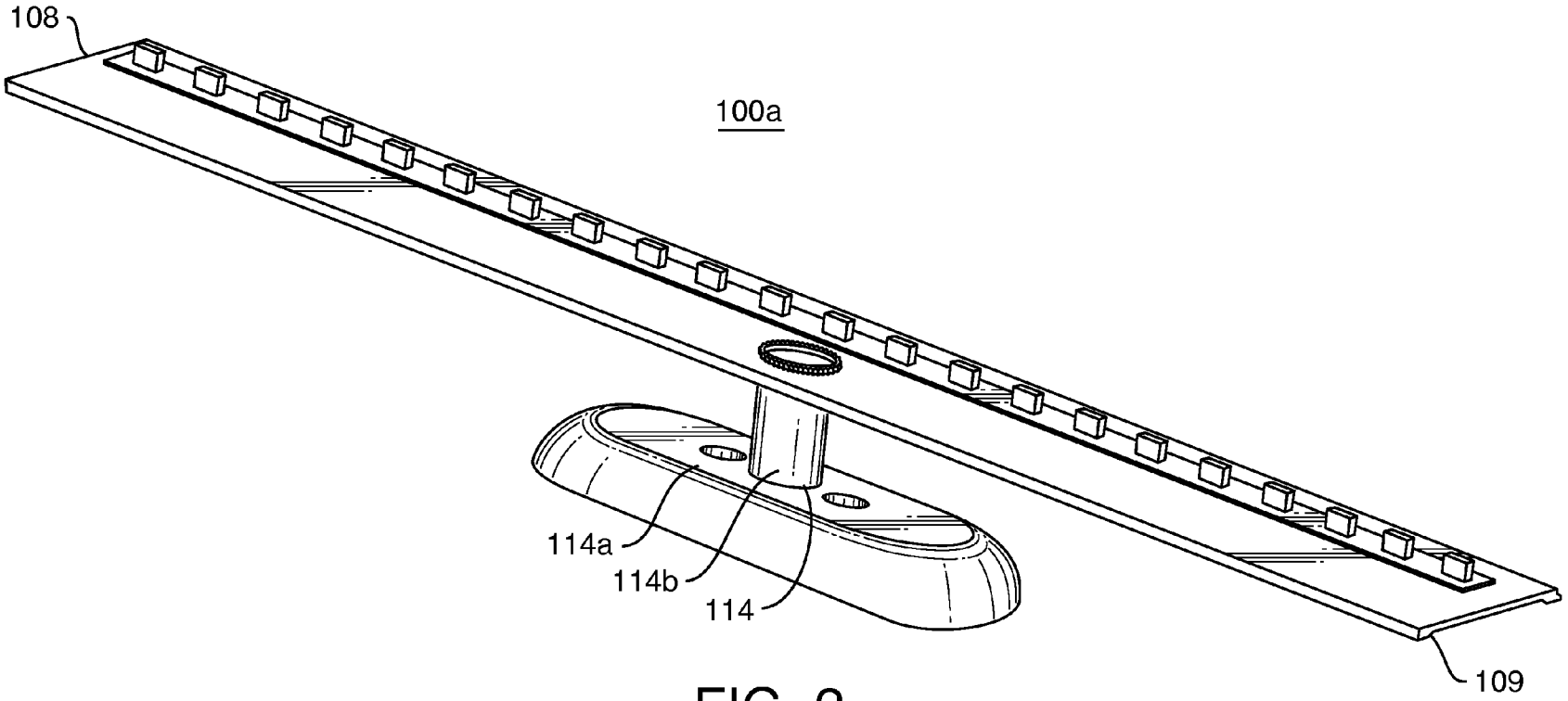
FIG. 2 is another perspective view of a lighting module in its first shape according to embodiments disclosed herein.

As seen most clearly in FIG. 2, the flexible housing 107 includes at least two ends 108, 109. In some embodiments, such as shown in FIG. 3, the flexible housing 107 includes an attachment mechanism 110. The attachment mechanism 110 allows two (or more) ends of the flexible housing 107, when the lighting module is in its linear shape 100, 100*a*, to be connected or otherwise joined to form the lighting module's non-linear shape 100*b*. Thus, the attachment mechanism 110 may be any known mechanism capable of allowing the ends of the flexible housing 107 to be attached together, and also unattached to return the lighting module to its original (i.e., linear, substantially linear, polygonal, etc.) shape. The attachment mechanism 110 is located on at least one of the at least two ends 108, 109. Of course, in some embodiments, the attachment mechanism is located on both and/or all of the at least two ends 108, 109. The attachment mechanism 110 is capable of allowing the at least two ends 108, 109 to be attached. In some embodiments, the attachment 110 mechanism is a clip 111, such as is shown in FIG. 4. The clip may be located on one end, or both ends, of the flexible housing 107. In some embodiments, such as shown in FIG. 3, the attachment mechanism 110 is a protrusion 112 that attaches to a receptacle 113. The protrusion 112 is located on a first 108 of the at least two ends 108, 109 and the receptacle 113 is located on a second 109 of the at least two ends 108, 109. The protrusion 112 fits into the receptacle 113 and secures the first end 108 to the second end 109 of the flexible housing. Of course, other attachment mechanisms 108 known in the art may be used without departing from the scope of the invention.

In some embodiments, as seen in FIGS. 1-5 and identified particularly in FIG. 2, the lighting module 100*a* includes a base 114 mounted to the flexible housing 107. The base 114 provides support to the lighting module 100*a* and allows the lighting module 100*a* to itself stand on, or otherwise be mounted and/or attached to, one or more surfaces. In some embodiments, the base 114 may include at least one post that allows the lighting module 100, 100*a*, 100*b* to be turned in any number of directions. The at least one post may also provide additional structural support for the lighting module 100, 100*a*, 100*b*. Thus, in some embodiments, the base 114 includes two posts or three or more posts. In some embodiments, such as is seen in FIG. 2, the base 114 is formed of at least two parts, a base mount 114*a* and a swivel stand 114*b*. The base mount 114 *a* and the swivel stand 114*b* allow the lighting module 100, 100*a*, 100*b* to be rotated and/or swiveled into different positions, so that the light emitted from the lighting module 100, 100*a*, 100*b* is directed in a particular direction at one time and in a different direction at a different time, without having to unattach or otherwise move the base mount 114*a* from the surface and/or surfaces it is currently in contact with.

In some embodiments, the flexible housing 107 may additionally serve as a thermal management component to assist in dissipating heat generated by the plurality of solid state light sources 106. In some embodiments, the flexible housing 107, when in a non-linear shape, such as the rounded/circular shape shown in FIGS. 3 and 4, may have its interior (i.e., where the flexible substrate 102 with the plurality of solid state light sources 106 is located) surface 120 coated with a reflective material, such as but not limited to white paint, or any other suitable reflective material. In some embodiments, both the interior surface 120 and an exterior surface 121 of the flexible housing 107 may be so coated, either in their entirety or a portion thereof. The shape and/or texture of the interior surface 120 of the flexible housing 107 may be designed so as to generate a particular beam pattern and/or light distribution.

In some embodiments, and as seen in FIG. 5, more than one flexible substrate 102, each including a plurality of solid state light sources 106, may be placed on a single flexible housing 107. In such embodiments, the flexible substrates 102*a*, . . . , 102*n* may be then be arranged according to a user's desires when the lighting module is in, for example, its linear shape 100, 100*a*. That is, a user may desire to receive more light from a center of the lighting module in its linear shape 100, 100*a*, and thus the user may arrange the flexible substrates 102*a*, . . . , 102*n* to achieve such a result. As another example, a user may want more light, or light of a different color, to be on one side of the lighting module in its linear shape 100, 100*a*, and thus may arrange the flexible substrates 102*a*, . . . , 102*n* to achieve such a result. The same results are also possible with the lighting module in its non-linear shape 100*b*. For example, a user may desire the lighting module 100 to emit white light when used for reading, but may desire light of a particular color (e.g., red, blue, etc.) or colors when the lighting module 100 is used for other purposes (e.g., as decorative lighting). In the first instance, the user may thus place a first flexible substrate 102*a* containing a plurality of solid state light sources 106*a* that emit only white light within the non-linear shaped module 100*b*; in the second instance, the user may remove the first flexible substrate 102*a* and replace it with a flexible substrate 102*b* containing a plurality of solid state light sources 106*b* that emit light of a particular color and/or colors.

In some embodiments, instead of including the base 114 as shown in FIGS. 1-5, the module may instead include one or more attachment mechanisms that allow one or more of the modules to be placed within an automotive lighting fixture, such as but not limited to a headlamp fixture and/or a tail lamp fixture. In such embodiments, the module may easily be moved between the headlamp fixture and the tail lamp fixture, or between different model cars. This would allow the user to purchase a single product capable of being used in multiple automobile models, reducing costs and logisitics. In such embodiments, components such as the base 114 and the cover 101 may removed for proper attachment to an automotive lighting fixture.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lighting module comprising:

a flexible substrate having a first side and a second side, wherein the first side includes conductive traces;

a plurality of solid state light sources placed on the first side of the flexible substrate, the plurality of solid state light sources being electrically connected to the conductive traces; and a flexible housing having at least a first shape and a second shape, the flexible housing comprising a flexible superelastic material in an austenite phase, wherein the flexible housing is placed in proximity to the flexible substrate to form the lighting module.

2. The lighting module of claim 1, wherein the flexible superelastic material has a mechanical strength capable of supporting at least the first shape and the second shape of the flexible housing.

3. The lighting module of claim 1, wherein the flexible superelastic material is a flexible superelastic material capable of deforming reversibly from the first shape to the second shape in the presence of a mechanical load.

4. The lighting module of claim 3, wherein the flexible superelastic material is a flexible superelastic material capable of returning to the first shape of the flexible housing after the removal of the mechanical load.

5. The lighting module of claim 1, wherein the flexible housing has at least two ends and comprises an attachment mechanism on at least one of the at least two ends, the attachment mechanism capable of allowing the at least two ends to be attached.

6. The lighting module of claim 5, wherein the attachment mechanism is a clip.

7. The lighting module of claim 5, wherein the attachment mechanism is a protrusion that attaches to a receptacle, wherein the protrusion is located on a first of the at least two ends and the receptacle is located on the second of the at least two ends.

8. The lighting module of claim 1, wherein the first shape is a substantially linear shape.

9. The lighting module of claim 8, wherein the second shape is a substantially circular shape.

10. The lighting module of claim 1, wherein the flexible housing is directly attached to the flexible substrate to form the lighting module.

11. The lighting module of claim 1, wherein the first side of the flexible substrate is reflective.

12. The lighting module of claim 11, wherein the second side of the flexible substrate is reflective.

13. The lighting module of claim 1, further comprising a base mounted to the flexible housing to support the lighting module.

14. The lighting module of claim 3, wherein the mechanical load is a cover for the lighting module in the second shape.

15. The lighting module of claim 14, wherein the cover is an optical system to focus light emitting from the lighting module in the second shape.

16. The lighting module of claim 14, wherein the cover is a reflective end cap for the lighting module in the second shape.

17. The lighting module of claim 1, wherein the flexible superelastic material is an alloy.

18. The lighting module of claim 17, wherein the alloy is a nickel-titanium alloy.

19. A lighting module comprising:

a flexible circuit board having a first side and a second side, wherein the first side includes conductive traces;

a plurality of solid state light sources placed on the first side of the flexible circuit board, the first side of the flexible circuit board being reflective, the plurality of solid state light sources being electrically connected to the conductive traces;

a flexible housing having at least a first shape and a second shape, the flexible housing having a mechanical strength capable of supporting at least the first shape of the flexible housing, the flexible housing capable of deforming reversibly in the presence of a mechanical load to achieve the second shape and capable of regaining the first shape of the flexible housing after the removal of the mechanical load, wherein the flexible housing is attached to the flexible circuit board to form the lighting module;

an attachment mechanism located on at least one end of the flexible housing, the attachment mechanism capable of allowing the at least one end to be attached to at least another end of the flexible housing; and a base mounted to the flexible housing to support the lighting module.

* * * * *